US007817933B2

(12) United States Patent
Thayer et al.

(10) Patent No.: US 7,817,933 B2
(45) Date of Patent: Oct. 19, 2010

(54) CLEANING METHOD FOR COMPENSATING FOR ENVIRONMENTAL CONDITIONS AND BLADE AGE IN A CLEANING SUBSYSTEM

(75) Inventors: Bruce E Thayer, Webster, NY (US); Richard W Seyfried, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 373 days.

(21) Appl. No.: 12/136,088

(22) Filed: Jun. 10, 2008

(65) Prior Publication Data

US 2009/0304402 A1 Dec. 10, 2009

(51) Int. Cl.
*G03G 15/00* (2006.01)

(52) U.S. Cl. ..... 399/71; 399/44; 399/123; 399/351

(58) Field of Classification Search ..... 399/34, 399/44, 71, 94, 97, 123, 345, 350, 351; 15/256.5, 15/256.51, 256.52
See application file for complete search history.

(56) References Cited

U.S. PATENT DOCUMENTS 4,202,437 A * 5/1980 Gordon ..... 198/497
5,208,639 A 5/1993 Thayer et al.
6,311,038 B1 * 10/2001 Schlueter ..... 399/350
6,393,250 B1 * 5/2002 Tsukida et al. ..... 399/350

OTHER PUBLICATIONS

U.S. Appl. No. 11/877,770, filed Oct. 24, 2007 and entitled Long Life Cleaning System With Replacement Blades by Bruce E. Thayer et al.
U.S. Appl. No. 12/021,500, filed Jan. 29, 2008 and entitled Dual Blade Cleaning System by Bruce E. Thayer et al.
U.S. Appl. No. 12/136,087, filed Jun. 10, 2008 and entitled Variable Interference Cleaning Blade Method by Bruce E. Thayer et al.
U.S. Appl. No. 12/136,086, filed Jun. 10, 2008 and entitled Method for Adjusting Cleaning Blade Load on a Photoreceptor by Bruce E. Thayer et al.

* cited by examiner

*Primary Examiner*—David P Porta
*Assistant Examiner*—Benjamin Schmitt

(57) ABSTRACT

A method for controlling blade interference in a single blade or multi-blade xerographic cleaner based on a look-up table for environmental conditions and blade age. Temperature and humidity sensors and a blade age counter are used to provide information to a controller, which adjusts the blade interference through a stepper motor based on the preloaded table. This allows lower blade load in most conditions over life, compared to the known method of setting the initial load high enough to cover these stress factors at worse case levels. The look-up table is empirically determined for a give blade material and xerographic system, e.g., photoreceptor, toner, etc. It takes into account the variation in blade load itself as a function of the environment and blade age.

20 Claims, 3 Drawing Sheets

CLEANING METHOD FOR COMPENSATING FOR ENVIRONMENTAL CONDITIONS AND BLADE AGE IN A CLEANING SUBSYSTEM

Cross referenced is copending and commonly assigned U.S. application Ser. No. 11/877,770, filed Oct. 24, 2007 and entitled LONG LIFE CLEANING SYSTEM WITH REPLACEMENT BLADES by Bruce E. Thayer et al.; U.S. application Ser. No. 12/021,500, filed Jan. 29, 2008 and entitled DUAL BLADE CLEANING SYSTEM by Bruce E. Thayer et al., U.S. application Ser. No. 12/136,086, filed Jun. 10, 2008 and entitled METHOD FOR ADJUSTING CLEANING BLADE LOAD ON A PHOTORECEPTOR by Bruce E. Thayer et al.; and U.S. application Ser. No. 12/136,087, filed Jun. 10, 2008 and entitled VARIABLE INTERFERENCE CLEANING BLADE METHOD by Bruce E. Thayer et al., all of which are included in their entirety herein by reference.

This disclosure relates to an electrostatographic printing system that employs an imaging device, and more particularly, to cleaning residual toner from a charge retentive surface of the imaging device.

Electrostatographic machines including printers and copiers form a latent image on the surface of photosensitive material which is identical with an original image, brings toner-dispersed developer into contact with the surface of the photosensitive material, and sticks toner particles only onto the latent image with electrostatic force to form a copied image on a copy sheet. Thus, a toner image is produced in conformity with the original image. The toner image is then transferred to a substrate and the image affixed thereto to form a permanent record of the image to be produced. Although a preponderance of the toner forming the image is transferred to the substrate during transfer, some toner invariably remains on the charge retentive surface of the photosensitive material, it being held thereto by relatively high electrostatic and/or mechanical forces. Additionally, paper fibers, toner additives, kaolins and other debris have a tendency to be attracted to the charge retentive surface. It is essential for optimal imaging that the toner and debris remaining on the charge retentive surface be cleaned therefrom for quality images to be produced by the machines.

"Blade cleaning" is a technique for removing toner and debris from a photoreceptor. In a typical application as disclosed in U.S. Pat. No. 5,208,639 which is included herein by reference, a relatively thin elastomeric blade member is supported adjacent to and transversely across the photoreceptor surface with a blade edge that chisels or wipes toner from the surface. Toner accumulating adjacent to the blade is transported away from the blade area by a toner transport arrangement or by gravity. Blade cleaning is advantageous over other cleaning systems due to its low cost, small cleaner unit size, low power requirements, and simplicity.

However, conventional blade cleaning systems suffer from the influence of changes in environmental conditions. Cleaning can become difficult at temperature extremes and blade material stiffness changes with temperature. For systems where the cleaning stress occurs at high temperatures, the blade load is decreased because of a reduction in blade modulus. At low temperatures, where cleaning is easier, the blade load increases because of an increase in blade modulus. Traditional cleaning blade systems have sufficient blade load to clean well at high temperatures and to operate at higher blade loads under nominal temperature conditions and even higher blade loads at low temperature conditions. This design approach results in blades experiencing high wear rates and shorter lives than necessary to perform the cleaning function.

Humidity affects toner adhesion, and thus, the blade load required for cleaning. Blade load relaxes over time, resulting in higher initial loads to compensate for loss of load later. The rate of blade load relaxation is a function of the environmental conditions.

Accordingly, there is an unmet need for systems and/or methods that facilitate overcoming the aforementioned deficiencies.

In accordance with various aspects described herein, a method is disclosed for sensing machine environmental conditions and adjusting blade interference to obtain a desired blade load. Temperature and humidity sensors mounted in the machine provide signals to a controller. The controller contains look-up tables of blade to photoreceptor interferences as a function of machine environmental conditions and time since blade installation. The controller provides a signal to stepper motors that then adjust blade to photoreceptor interference to obtain the desired blade load. The look-up tables are derived from information of the optimum cleaning blade load as a function of environment, blade load relaxation as a function of time, and blade load variation as a function of environmental conditions.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
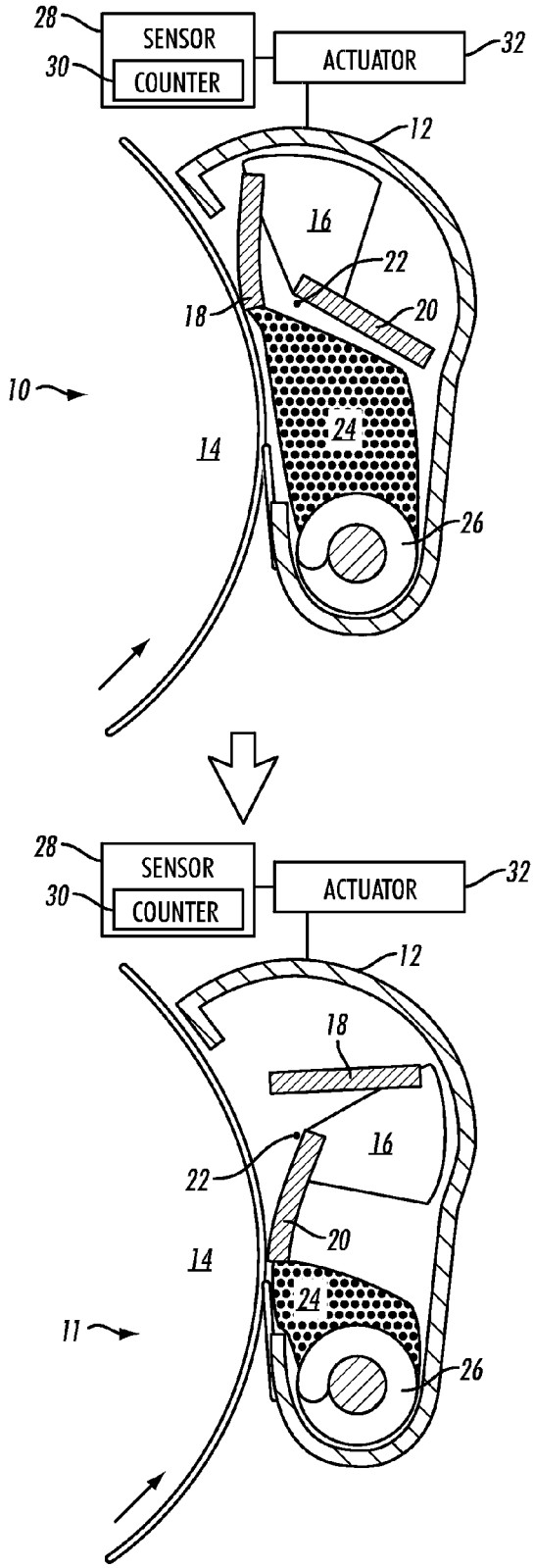
FIG. 1 is a side view of a cleaning system that enables blade cleaning performance sensing and adjustment of blade to photoreceptor interference.

With reference to FIG. 1, a system is illustrated that facilitates replacing a used cleaning blade with a cleaning blade at the end-of-life (EOL) of the used cleaning blade, or at any other desired replacement time while simultaneously adjusting blade interference to provide the minimum load high quality cleaning. The system is illustrated in a first orientation 10 wherein the first cleaning blade is in use, and in a second orientation 11, wherein the second cleaning blade is in use. The system comprises a cleaner unit 12, that is in operational contact with a photoreceptor 14, and houses a blade holder 16, which in turn has a first blade 18 and a second blade 20 attached thereto. The blade holder 16 pivots about a pivot point 22 to position the first or second blade against the surface of the photoreceptor 14, which has a direction of rotation indicated by the arrow at the bottom of the photoreceptor 14 (e.g., counterclockwise in this example). The blade, when placed against the surface of the photoreceptor 14, removes excess waste toner 24, which is directed toward a toner removal auger 26 that removes the waste toner 24 from the cleaner unit 12. Waste toner 24 may then be discarded, recycled, etc. Though some examples provided describe a system for cleaning moving photoreceptor surfaces 14, the cleaning system can also clean other image forming device moving surfaces, including but not limited to moving transfer surfaces such as biased transfer belts, biased transfer rolls, or intermediate transfer belts.

The system further comprises a sensor 28 that senses status information related to print quality, toner build-up, blade wear, or any other suitable parameter for determining an appropriate time for switching blades. The sensor can comprise one or more counters 30 that facilitate determining when to change a blade. An actuator 32 performs the blade change, and may be manual (e.g., a knob, lever, cam, or other actuating means that an operator manipulates to effectuate the blade change) or automatic (e.g., a motor, solenoid, etc.) that changes the blade in response to a sensed blade change condition.

Thus, the system comprises a compact cleaning blade unit having two or more blades that are positioned so that toner flow is not impeded and so that accumulated toner does not apply pressure to the operating blade. Simple rotation of the blade holder removes a used blade and replaces it with a new blade. The photoreceptor surface can be stationary or moving backwards from normal operation during blade replacement. The sensor 28 detects accumulated blade use in one or more ways. For instance, the counter 30 can measure blade use as a function of a number of prints and/or as a function of photoreceptor cycles.

In accordance with the present disclosure, a control system is provided that will adjust blade interference in the xerographic cleaner unit of FIG. 1 based on a look-up table for environmental conditions and blade age. Temperature sensors and a blade counter are included to provide information to a controller which, in turn, adjusts the blade interference through a stepper motor based on the preloaded table. This facilitates lower blade load in most conditions over the life of the blade than heretofore has been possible in systems that set the initial load high enough to cover these stress factors at worse case levels. The look-up table is empirically determined from a give blade material and xerographic system, such as, photoreceptor, toner, etc. It also takes into account the variation in blade load required to clean, and the variation in blade load itself as a function of environment and blade age. This control system and method can be used for a single blade cleaner unit configuration or multiple blade configurations which rotate the blades into position.

Table 1 shows an example of the minimum blade load required to clean toner from a photoreceptor under varying conditions. In dry environments toner charge tends to be higher and increase the adhesion of the toner to the photoreceptor. Because of the higher adhesion a higher blade load is required to clean the toner. Blade rebound is reduced in lower temperatures and increased in higher temperatures. The minimum cleaning blade loads at varying environmental conditions need to be determined for each blade material, toner, development system, transfer system and photoreceptor. Once the minimum cleaning blade loads have been determined for ranges of temperature and relative humidity, Table 1 can be constructed. The minimum cleaning load can be found from the table by interpolation.

TABLE 1

Example: minimum blade load for expected cleaning as a function of environmental conditions

| | | Relative Humidity | | |
|---|---|---|---|---|
| | | Dry | Nominal | Wet |
| Temperature | Cold | 14 g/cm | 12 g/cm | 11 g/cm |
| | Nominal | 17 g/cm | 15 g/cm | 14 g/cm |
| | Hot | 20 g/cm | 18 g/cm | 17 g/cm |

Table 2 below shows an example of the change in blade load from nominal as environmental conditions vary. Hot temperatures decrease the blade material modulus and soften the blade. Cold temperatures increase the blade material modulus and stiffen the blade. Dry temperatures stiffen the blade slightly and wet conditions soften the blade slightly. These changes in blade load can easily be determined by measuring blade load or blade material properties in a range of environmental conditions, preferably in a controlled environmental test chamber.

TABLE 2

Example: change in blade load as a function of environmental conditions

| | | Relative Humidity | | |
|---|---|---|---|---|
| | | Dry | Nominal | Wet |
| Temperature | Cold | +4 g/cm | +3 g/cm | +2 g/cm |
| | Nominal | +1 g/cm | 0 g/cm | −1 g/cm |
| | Hot | −1 g/cm | −2 g/cm | −3 g/cm |

Table 3 hereinafter shows the blade interferences required to obtain the blade loads shown in Table 1 with blade loads varying due to temperature and relative humidity as shown in Table 2. Table 3 is the basis for an interference look-up table used by the machine controller to control blade load. The table can be expanded by interpolation between table cells or interpolation can be used for each individual environmental condition as needed by the controller. Actual look-up table values would be increased somewhat to account for process and piece part tolerances. The cleaner would not operate at the minimum blade load for cleaning, but rather enough above that blade load so that tolerances did not reduce the load below that for expected cleaning.

TABLE 3

Example: blade interferences for good cleaning as a function of environmental conditions

| | | Relative Humidity | | |
|---|---|---|---|---|
| | | Dry | Nominal | Wet |
| Temperature | Cold | 1.33 mm | 1.20 mm | 1.20 mm |
| | Nominal | 2.13 mm | 2.00 mm | 2.00 mm |
| | Hot | 2.80 mm | 2.67 mm | 2.67 mm |

Figure 2:
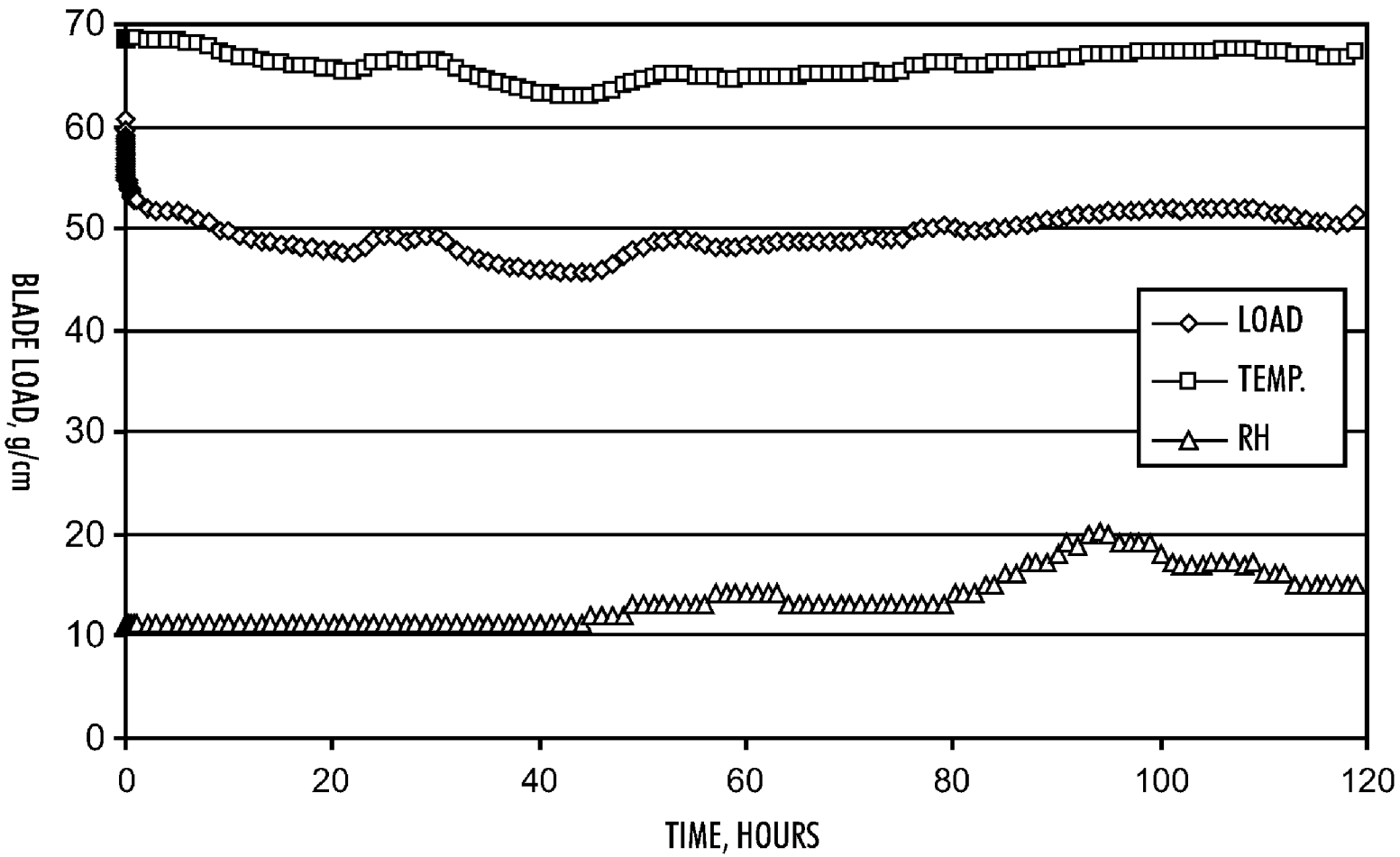
FIG. 2 is a chart showing blade load relaxation time with minor environmental variations.

FIG. 2 shows the relaxation of a blade over time. The blade load drops exponentially as a function of time. The blade load does not drop smoothly in this example due to the environmental conditions not being controlled. If the test were repeated under temperature and relative humidity conditions the blade load would smoothly follow a decaying exponential curve. FIG. 2 is a useful example of how environmental conditions impact blade load. The right hand portion of the blade load curve tends to mimic the variations in temperature. The variations in relative humidity do not appear to have much of an affect, but the relative humidity variation is very small. The blade relaxation over time is mostly a concern in the very early part of the blade life. For blades loaded against photoreceptor drums in print cartridges the load relaxation will typically take place when the print cartridge is in the box waiting to be used. In these cases control of blade interference to compensate for initial blade relaxation is of little worth. For machine mounted cleaners, however, the initial relaxation following blade installation will occur while the machine is in operation. For these applications compensation for blade load relaxation has value.

Figure 3:
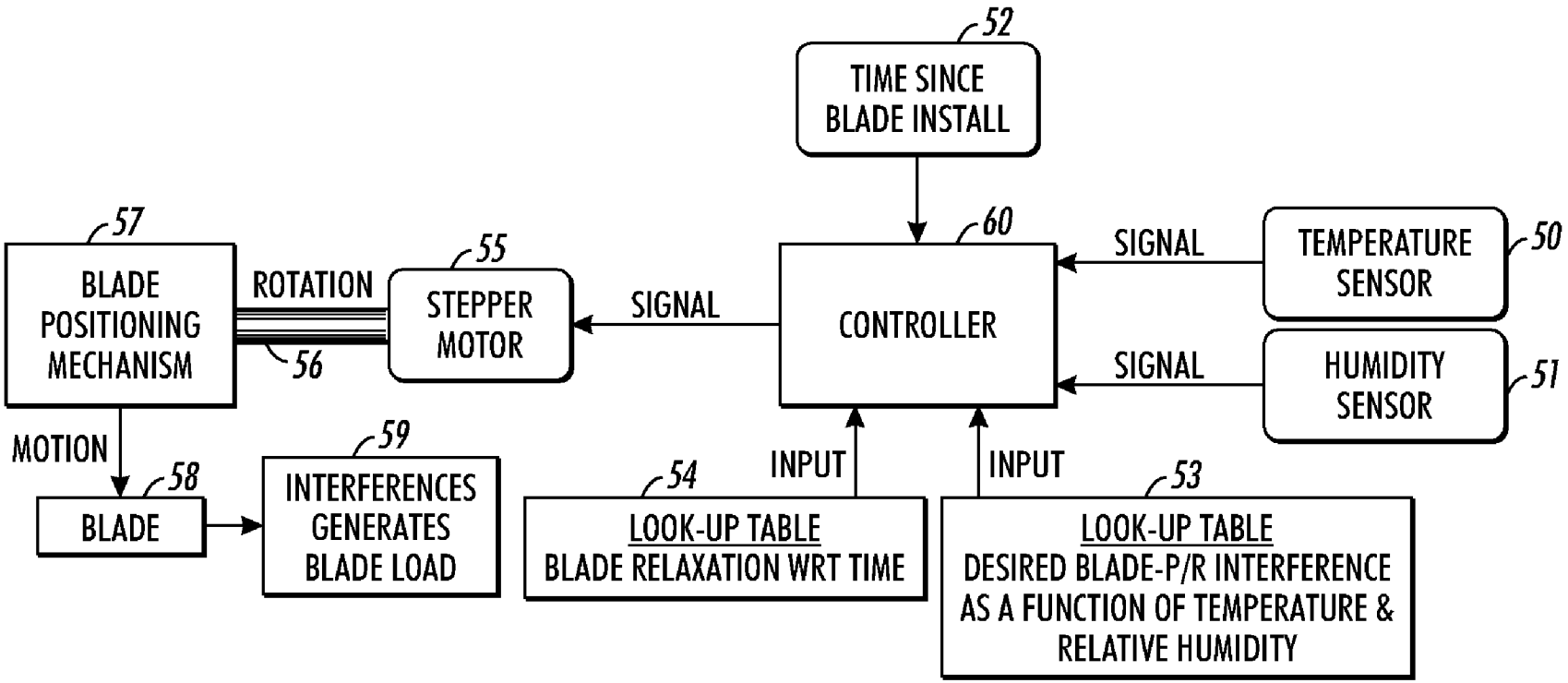
FIG. 3 is a schematic of a blade interference control system that compensates for environment and time.

FIG. 3 is a schematic of the system to control blade load by adjusting blade to photoreceptor interference in blocks 58 and 59, respectively. Blade interference is adjusted based on changes in machine temperature from block 50, relative humidity from block 51 and the time in block 52 since the blade was installed in the machine. Look-up tables in blocks 53 and 54 or equations fit to experimental data provide the necessary information to the controller 60 to convert time, temperature and humidity data into desired blade interference. Controller 60 sends a signal to turn ON stepper motor 55 which through rotation of shaft 56 that is connected to blade holder 16 drives a blade positioning mechanism 57 which could be a conventional rack and pinion mechanism, lead screw or other conventional mechanism to advance or retract the blade 58 from photoreceptor surface 14 as in block 59. Higher blade interference increases blade load and lower interference decreases blade load.

A number of advantages are obtained with this blade control system including longer blade life due to reduced blade wear from environmental conditions, i.e., controlled blade load is lower than fixed load set to worst case condition. Also, environmental conditions compensated blade load reduces wear and leads to longer photoreceptor life. Cleaning latitude is enhanced because blade load tolerance is reduced due to environmental conditions compensation. For example, piece part tolerances can be relaxed due to compensation for environmental variations, as well as, lower cost piece parts due to looser tolerances. In addition, lower cost temperature and humidity compensation is obtained because some machines already include this technology and, if not, the technology is readily available with low cost, field proven devices.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for compensating for environmental variation and blade material relaxation in a blade cleaning system, comprising:

providing a surface to be cleaned;

providing at least one cleaning blade mounted within a blade holder and positioned for cleaning said surface;

providing a blade positioning mechanism drivingly connected to said cleaning blade for moving said cleaning blade to increase or decrease blade load against said surface;

providing a stepper motor drivingly connected to said blade positioning mechanism for rotating said blade positioning mechanism;

providing sensors for measuring time since the last blade install, temperature and humidity;

providing a first look-up table that includes blade relaxation with respect to time;

providing a second look-up table that includes blade to photoreceptor interference as a function of temperature and relative humidity; and providing a controller and wherein said first and second look-up tables are preloaded within said controller, and wherein said controller is adapted to receive signals from said sensors for measuring time since the last blade install, temperature and humidity and in turn send a signal to actuate said stepper motor to thereby move said cleaning blade with respect to said surface to obtain a desired blade load.

2. The method of claim 1, wherein said surface is a photoreceptor.

3. The method of claim 2, wherein said sensor for measuring time since the last blade install is a counter.

4. The method of claim 3, wherein said cleaning system is a xerographic cleaning system.

5. The method of claim 4, including providing multiple cleaning blades in said blade cleaning system.

6. The method of claim 5, including pivoting said blade holder about a predetermined pivot point to position another of said multiple blades against said photoreceptor.

7. The method of claim 6, including moving said photoreceptor backwards while pivoting said blade holder and positioning said another blade against said photoreceptor.

8. The method of claim 3, including increasing blade load against said photoreceptor in dry environments.

9. The method of claim 8, including reducing blade load against said photoreceptor in temperatures lower than nominal.

10. The method of claim 9, including increasing blade load against said photoreceptor in temperatures higher than nominal.

11. A method for sensing machine environmental conditions and adjusting blade interference against a surface to obtain a desired blade load, comprising:

providing a surface to be cleaned;

providing at least one cleaning blade mounted within a blade holder and positionable for cleaning said surface;

providing a blade positioning mechanism drivingly connected to said cleaning blade for moving said cleaning blade to increase or decrease blade load against said surface;

providing a stepper motor drivingly connected to said blade positioning mechanism for rotating said blade positioning mechanism;

providing sensors for measuring time since the last blade install, temperature and humidity; and providing a controller including a look-up table that includes blade relaxation with respect to time, and blade to photoreceptor interference as a function of temperature and relative humidity, and wherein said controller is adapted to receive signals from said sensors for measuring time since the last blade install, temperature and humidity and in turn send a signal to actuate said stepper motor to thereby move said cleaning blade with respect to said surface to obtain a desired blade load.

12. The method of claim 11, wherein said surface is a photoreceptor.

13. The method of claim 12, wherein said sensor for measuring time since the last blade install is a counter.

14. The method of claim 13, including mounting said cleaning blade in a xerographic blade cleaning system.

15. The method of claim 14, including providing multiple cleaning blades in said xerographic blade cleaning system.

16. The method of claim 15, including pivoting said blade holder about a predetermined pivot point to position another of said multiple blades against said photoreceptor.

17. The method of claim 13, including increasing blade load against said photoreceptor in environments dryer than nominal.

18. The method of claim 17, including reducing blade load against said photoreceptor in temperatures lower than nominal.

19. The method of claim 18, including increasing blade load against said photoreceptor in temperatures higher than nominal.

20. A method for compensating for environmental variation and blade material relaxation in a blade cleaning system, comprising:

providing a surface to be cleaned;

providing at least one cleaning blade mounted within a blade holder and positioned for cleaning said surface;

providing a blade positioning mechanism drivingly connected to said cleaning blade for moving said cleaning blade to increase or decrease blade load against said surface;

providing a stepper motor drivingly connected to said blade positioning mechanism for rotating said blade positioning mechanism;

providing sensors for measuring time since the last blade install, temperature and humidity;

providing an equation of empirical data that includes blade relaxation with respect to time and blade to photoreceptor interference as a function of temperature and relative humidity; and providing a controller, and wherein said equation is preloaded within said controller, and wherein said controller is adapted to receive signals from said sensors for measuring time since the last blade install, temperature and humidity and in turn send a signal to actuate said stepper motor to thereby move said cleaning blade with respect to said surface to obtain a desired blade load.

* * * * *